US011333458B1

(12) United States Patent
Hunt et al.

(10) Patent No.: US 11,333,458 B1
(45) Date of Patent: May 17, 2022

(54) UNDERWATER MUZZLE SUPPRESSOR SYSTEM

(71) Applicants: Courtland K. Hunt, Bradenton, FL (US); Aubrey N. Brown, Holmes Beach, FL (US); Daniel M. Gallagher, III, Plant City, FL (US)

(72) Inventors: Courtland K. Hunt, Bradenton, FL (US); Aubrey N. Brown, Holmes Beach, FL (US); Daniel M. Gallagher, III, Plant City, FL (US)

( * ) Notice: Subject to any disclaimer, the term of this patent is extended or adjusted under 35 U.S.C. 154(b) by 60 days.

(21) Appl. No.: 16/944,202

(22) Filed: Jul. 31, 2020

Related U.S. Application Data

(60) Provisional application No. 62/882,117, filed on Aug. 2, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38; F41C 9/06
USPC ..... 89/14.2–14.4; 181/223; 42/1.14
See application file for complete search history.

(56) References Cited

U.S. PATENT DOCUMENTS 748,157 A * 12/1903 Samuel ..... F01N 1/084 181/265
2,765,706 A * 10/1956 Strohl ..... F41A 21/36 89/14.3
3,677,132 A * 7/1972 Plenge ..... F41A 35/02 89/14.2
4,813,333 A * 3/1989 Garris ..... F41A 21/38 89/14.3
5,136,923 A * 8/1992 Walsh, Jr. ..... F41A 21/30 89/14.2
5,746,018 A * 5/1998 Kirschner ..... F41A 21/32 42/1.14
7,237,353 B1 * 7/2007 Beauchamp ..... F41A 21/36 42/1.14
8,196,701 B1 * 6/2012 Oliver ..... F41A 21/30 181/223
10,132,588 B2 * 11/2018 Salvador ..... F41A 21/325
10,180,299 B2 * 1/2019 Morreau ..... F41A 21/34
10,330,419 B1 * 6/2019 Holderby ..... F41A 21/30
10,890,403 B2 * 1/2021 Petersen ..... F41A 21/30
2010/0180759 A1 * 7/2010 Petersen ..... F41A 21/30 89/14.4

(Continued)

*Primary Examiner* — Joshua E Freeman
*Assistant Examiner* — Benjamin S Gomberg
(74) *Attorney, Agent, or Firm* — Lewellyn Law, PLLC; Stephen Lewellyn

(57) ABSTRACT

An underwater muzzle suppressor system for directing away from a user the blast pressure of a firearm has an interior cylinder with a rearward end and a forward end with primary axial slots formed in the interior cylinder adjacent to the rearward end. An exterior cylinder has a rearward end and a forward end with secondary axial slots formed in the exterior cylinder adjacent to the forward end. A cylindrical chamber is created between the interior cylinder and the exterior cylinder. A rearward disk is received over the rearward end of the interior cylinder. The rearward disk is coupled to the rearward end of the exterior cylinder. A forward disk receives the forward end of the interior cylinder. The forward disk is coupled to the forward end of the exterior cylinder. A plurality of axial holes are in the forward disk.

3 Claims, 3 Drawing Sheets

(56) References Cited

U.S. PATENT DOCUMENTS

| | | | | |
|---|---|---|---|---|
| 2016/0123689 | A1* | 5/2016 | Maeda | F41A 21/36<br>89/14.3 |
| 2018/0299223 | A1* | 10/2018 | Barrett | F41A 21/28 |
| 2020/0173751 | A1* | 6/2020 | Dome | F41A 21/30 |

* cited by examiner

FIG. 1
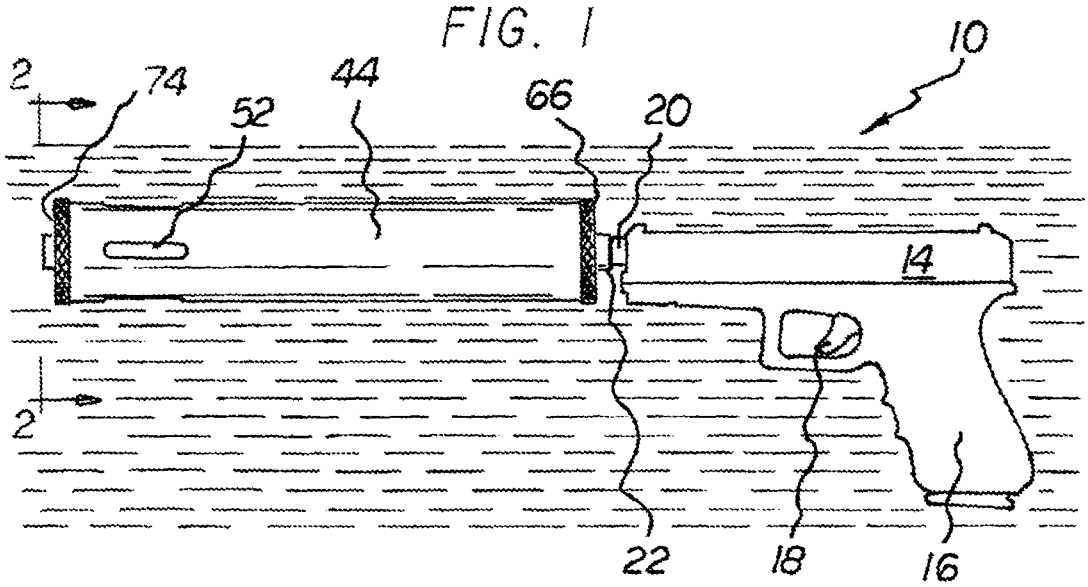
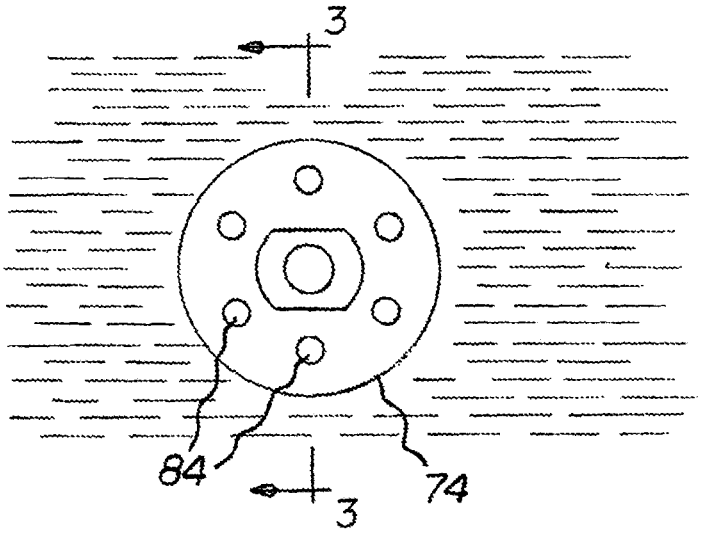
FIG 2

FIG. 3
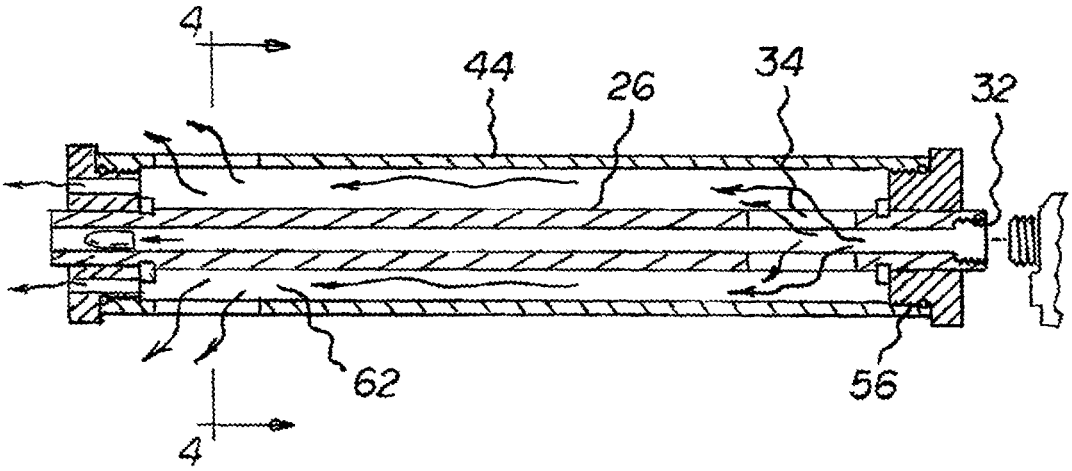
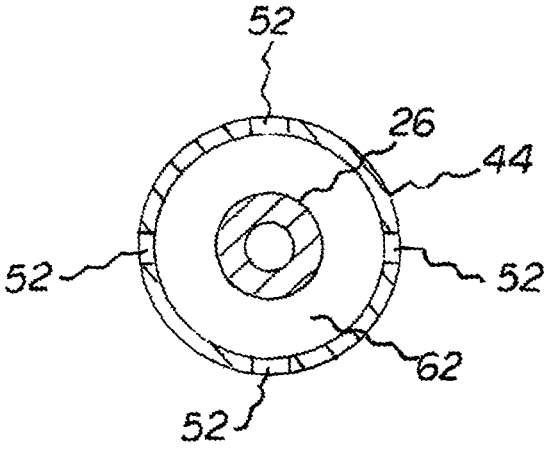
FIG. 4

UNDERWATER MUZZLE SUPPRESSOR SYSTEM

CROSS-REFERENCE TO RELATED APPLICATIONS

This Application claims the benefit of U.S. Provisional Application Ser. No. 62/882,117, filed Aug. 2, 2019, the entirety of which is incorporated herein by reference.

BACKGROUND OF THE INVENTION

Field of the Invention

The present invention relates to an underwater muzzle suppressor system and more particularly pertains to directing away from a user the blast pressure of a firearm.

Description of the Prior Art

The use of underwater firearms is known in the prior art. More specifically, underwater firearms previously devised and utilized are known to consist basically of familiar, expected, and obvious structural configurations, notwithstanding the myriad of designs encompassed by the crowded prior art which has been developed for the fulfillment of countless objectives and requirements.

While known devices fulfill their respective, particular objectives and requirements, the prior art does not describe underwater muzzle suppressor system that allows directing away from a user the blast pressure of a firearm.

In this respect, the underwater muzzle suppressor system according to the present invention substantially departs from the conventional concepts and designs of the prior art, and in doing so provides an apparatus primarily developed for the purpose of directing away from a user the blast pressure of a firearm.

Therefore, it can be appreciated that there exists a continuing need for a new and improved underwater muzzle suppressor system which can be used for directing away from a user the blast pressure of a firearm. In this regard, the present invention substantially fulfills this need.

SUMMARY OF THE INVENTION

In view of the disadvantages inherent in the known types of underwater firearms now present in the prior art, the present invention provides an improved underwater muzzle suppressor system. As such, the general purpose of the present invention, which will be described subsequently in greater detail, is to provide a new and improved underwater muzzle suppressor system and method which has all the advantages of the prior art and none of the disadvantages.

To attain this, the present invention essentially comprises an interior cylinder having a rearward end and a forward end with primary axial slots formed in the interior cylinder adjacent to the rearward end. An exterior cylinder has a rearward end and a forward end with secondary axial slots formed in the exterior cylinder adjacent to the forward end. A cylindrical chamber is created between the interior cylinder and the exterior cylinder. A rearward disk is received over the rearward end of the interior cylinder. The rearward disk is coupled to the rearward end of the exterior cylinder. A forward disk receives the forward end of the interior cylinder. The forward disk is coupled to the forward end of the exterior cylinder. A plurality of axial holes are in the forward disk.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved underwater muzzle suppressor system which has all of the advantages of the prior art underwater firearms and none of the disadvantages.

It is another object of the present invention to provide a new and improved underwater muzzle suppressor system which may be easily and efficiently manufactured and marketed.

It is further object of the present invention to provide a new and improved underwater muzzle suppressor system which is of durable and reliable constructions.

An even further object of the present invention is to provide a new and improved underwater muzzle suppressor system which is susceptible of a low cost of manufacture with regard to both materials and labor, and which accordingly is then susceptible of low prices of sale to the consuming public, thereby making such underwater muzzle suppressor system economically available to the buying public.

Lastly, it is an object of the present invention is to provide an underwater muzzle suppressor system for directing away from a user the blast pressure of a firearm.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an underwater muzzle suppressor system constructed in accordance with the principles of the present invention;

FIG. 2 is a front elevational; view taken along line 2-2 of FIG. 1;

FIG. 3 is a cross sectional; view taken along line 3-3 of FIG. 2;

FIG. 4 is a cross sectional; view taken along line 4-4 of FIG. 3.

The same reference numerals refer to the same parts throughout the various Figures.

DETAILED DESCRIPTION OF THE INVENTION

Figure 5:
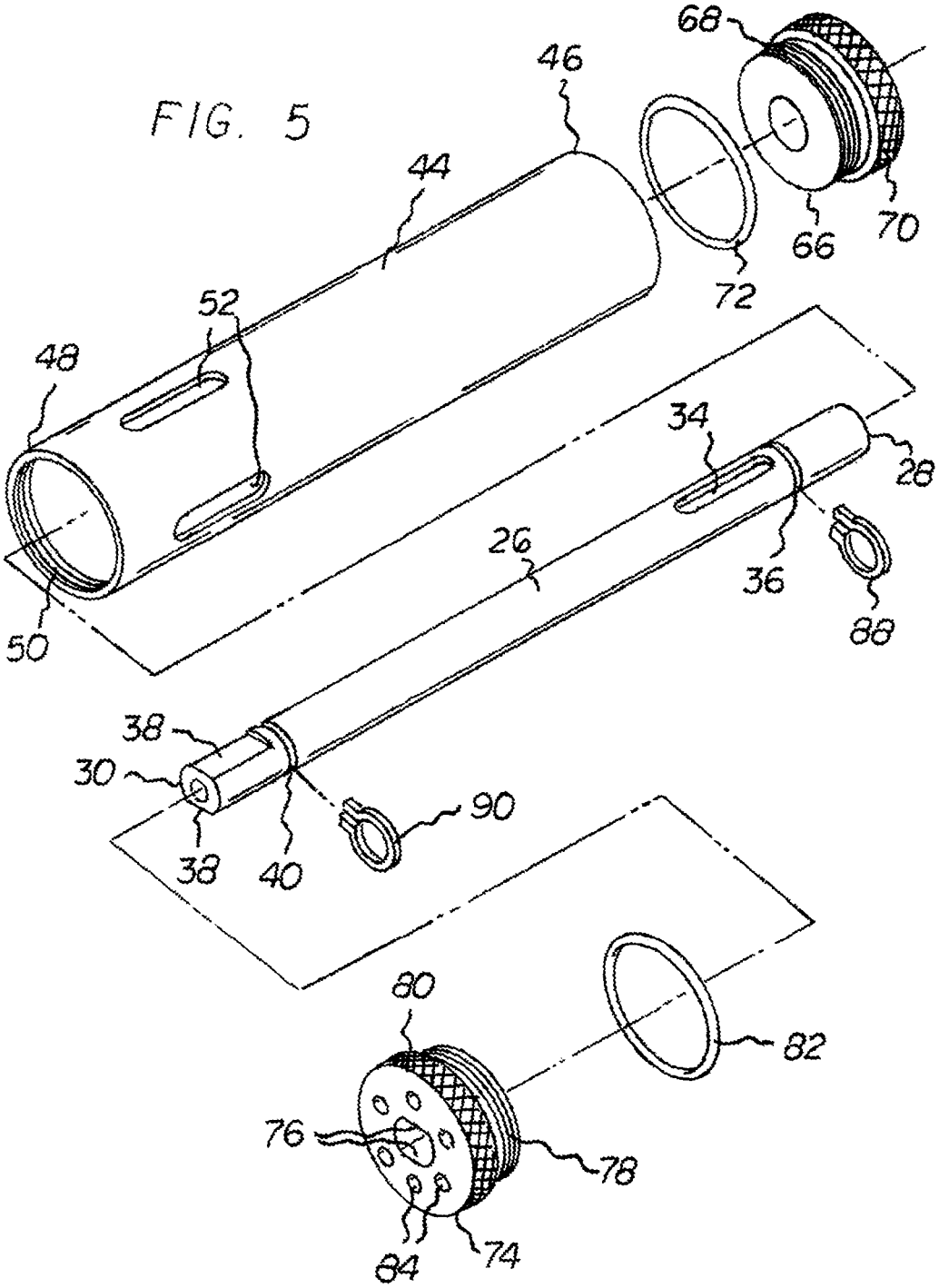
FIG. 5 is an exploded perspective illustration of the underwater muzzle suppressor system shown in the prior Figures.

With reference now to the drawings, and in particular to FIG. 1 thereof, the preferred embodiment of the new and improved underwater muzzle suppressor system embodying the principles and concepts of the present invention and generally designated by the reference numeral 10 will be described.

In this broad context, first provided is an interior cylinder. The interior cylinder has a rearward end and a forward end. Primary axial slots are formed in the interior cylinder adjacent to the rearward end. Next an exterior cylinder is provided. The exterior cylinder has a rearward end and a forward end. Secondary axial slots are formed in the exterior cylinder adjacent to the forward end. A cylindrical chamber is created between the interior cylinder and the exterior cylinder. A rearward disk is next provided. The rearward disk is received over the rearward end of the interior cylinder. The rearward disk is coupled to the rearward end of the exterior cylinder. Lastly, a forward disk is provided. The forward receives the forward end of the interior cylinder. The forward disk is coupled to the forward end of the exterior cylinder. A plurality of axial holes are formed in the forward disk.

More specifically, the underwater muzzle suppressor system 10 is for directing, away from a user, the blast pressure of a firearm in a safe, convenient, and economical manner.

In the preferred embodiment first provided is a firearm 14. The firearm has a handle 16, a trigger 18, and a barrel 20. The barrel has a forward end terminating in male screw threads 22.

Next provided is an interior cylinder 26. The interior cylinder 26 has a rearward end 28 and a forward end 30. The rearward end is formed with female screw threads 32 for removable coupling to the barrel. Two primary axial slots 34 are formed in the interior cylinder adjacent to the rearward end. A first annular recess 36 is formed in the interior cylinder between the female screw threads and the primary axial slots. Two outwardly facing axial flats 38 are formed axially in the interior cylinder adjacent to the forward end. A second annular recess 40 is formed in the interior cylinder rearwardly of the flats.

An exterior cylinder 44 is next provided. The exterior cylinder has a rearward end 46 and a forward end 48. The forward end is formed with female screw threads 50. Four secondary axial slots 52 are formed in the exterior cylinder adjacent to the forward end. Female screw threads 56 are formed in the interior cylinder adjacent to the rearward end. A cylindrical chamber 62 is created between the interior cylinder and the exterior cylinder.

Next, a rearward disk 66 is provided. The rearward disk is slidably received over the rearward end of the interior cylinder. The rearward disk has male screw threads 68 threadedly coupled to the female screw threads of the rearward end of the exterior cylinder. The rearward disk has a first knurled surface 70 rearwardly. A first elastomeric O-ring 72 is provided on the rearward disk between the male screw threads and the first knurled surface.

Next provided is a forward disk 74. The forward disk has two inwardly facing axial flats 76 slidably receiving the forward end of the interior cylinder. The forward disk has male screw threads 78 threadedly coupled to the female screw threads of the forward end of the exterior cylinder. The forward disk has a second knurled surface 80 forwardly. A second elastomeric O-ring 82 is provided on the forward disk between the male screw threads and the second knurled surface. A plurality of axial holes 84 are formed in the forward disk.

Lastly, a first clip 88 is provided in the first annular recess and a second clip 90 is provided in the second annular recess. The first clip and the second clip provide bearing surfaces for the rearward disk and the forward disk respectively to abate axial movement between the interior cylinder and the exterior cylinder during use.

The present invention is designed primarily for redirecting, away from the user, the blast pressure of a firearm underwater. The primary result is a safer experience and less felt concussion to the user's body while also mitigating the exposure to the surrounding marine environment. This is accomplished by directing the blast at many different angles and dividing the resulting gasses in many different directions. The device attaches to the end of the firearm in a way that the bullet and blast energy, upon exiting the native firearm barrel, must pass through the system before entering the marine environment. Outside of the water, on land and in the absence of water, the device functions as a flash hider or flash suppressor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An underwater muzzle suppressor system comprising:

an exterior tubular cylinder having a rearward end and a forward end, the exterior tubular cylinder having an internal space extending between the rearward and forward ends;

a forward disk attached to the forward end of the exterior tubular cylinder;

a rearward disk attached to the rearward end of the exterior tubular cylinder;

an interior tubular cylinder disposed within the internal space, the interior tubular cylinder having a bore wall defining a bore for receiving and transporting a projectile, a forward end of the interior tubular cylinder slidably disposed through an aperture in the forward disk, and a rearward end of the interior tubular cylinder slidably disposed through an aperture in the rearward disk, the interior tubular cylinder being captively held in the internal space to stop the interior tubular cylinder from axial movement relative to the forward disk and the rearward disk;

a chamber defined by an outer wall surface of the interior tubular cylinder and an inner wall surface of the exterior tubular cylinder, the chamber receiving, through one or more first slots in the bore wall, a combustion gas from the bore that is produced by the firing of the projectile, the one or more first slots being located at the rearward end of the interior tubular cylinder and adjacent the rearward disk;

one or more second slots disposed in the forward end of the exterior tubular cylinder for transmission of the combustion gas from the chamber to an exterior of the suppressor system;

wherein the combustion gas in the bore only exits the bore through the one or more first slots and through the forward end of the interior tubular cylinder;

a first clip removably disposed in a first annular groove formed in the forward end of the interior tubular cylinder, the first clip in abutment with the forward disk;

a second clip removably disposed in a second annular groove formed in the rearward end of the interior tubular cylinder, the second clip in abutment with the rearward disk; and wherein the abutment between the first clip and the forward disk and the abutment between the second clip and the rearward disk captively hold the interior tubular cylinder relative to the forward disk and the rearward disk.

2. The system as set forth in claim 1, further comprising:

a plurality of gas vents through the forward disk for the transmission of the combustion gas from the chamber to the exterior of the suppressor system.

3. The system as set forth in claim 2, wherein:

the forward disk is threadedly connected to the forward end of the exterior tubular cylinder; and the rearward disk is threadedly connected to the rearward end of the exterior tubular cylinder.

* * * * *